United States Patent [19]

Oyabu et al.

[11] Patent Number: 4,581,063

[45] Date of Patent: Apr. 8, 1986

[54] METHOD AND APPARATUS FOR MELTING METAL INGOTS

[75] Inventors: Kunio Oyabu; Toshihiko Uehara; Makoto Otani, all of Nagoya; Katsuaki Masaki, Toyoake; Seiji Kamimura, Sagamihara, all of Japan

[73] Assignees: Sumitomo Light Metal Industries Ltd., Japan; Shinagawa Furnace Co., Ltd., of JPX

[21] Appl. No.: 728,884

[22] Filed: Apr. 30, 1985

[30] Foreign Application Priority Data

May 3, 1984 [JP] Japan ..... 59-88983
May 3, 1984 [JP] Japan ..... 59-88984

[51] Int. Cl.[4] ..... C22B 21/00

[52] U.S. Cl. ..... 75/65 R; 75/68 R; 266/200; 266/900; 266/901

[58] Field of Search ..... 75/65 R, 68 R; 266/901, 266/900, 200

[56] References Cited

U.S. PATENT DOCUMENTS 4,353,532 10/1982 Jay ..... 75/68 R

*Primary Examiner*—Melvyn J. Andrews
*Attorney, Agent, or Firm*—Parkhurst & Oliff

[57] ABSTRACT

A method and an apparatus for melting a metallic material in the form of a pile of elongate metal ingots, wherein the ingot pile are pre-heated in a horizontal pre-heating chamber while the pile is moved from its one end to the other end, and the pre-heated pile at the other end is pushed into a melting chamber which communicates with the pre-heating chamber and extends vertically downwardly from the other end of the pre-heating chamber, whereby the pile is turned sideways before falling down into the melting chamber, with a result of collapse of the pile into the individual metal ingots in the melting chamber. The melting apparatus may comprise a damper device having at least one damper member which is movable between its retracted position, and its operated position at which the damper member closes a space between an inner wall surface of the pre-heating chamber and the opposite surface of the ingot pile, and thereby intercepts flow of exhaust gases from the melting chamber through the space between the wall surface and the ingot pile.

20 Claims, 19 Drawing Figures

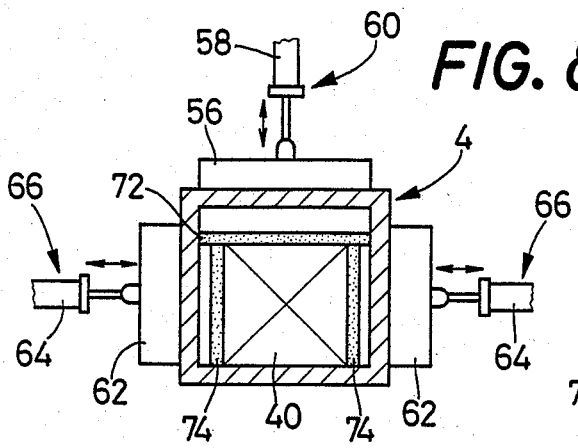
FIG. 8
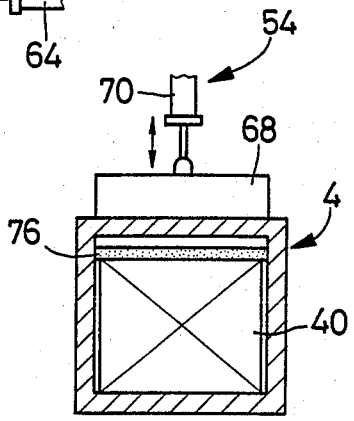
FIG. 9
FIG. 11
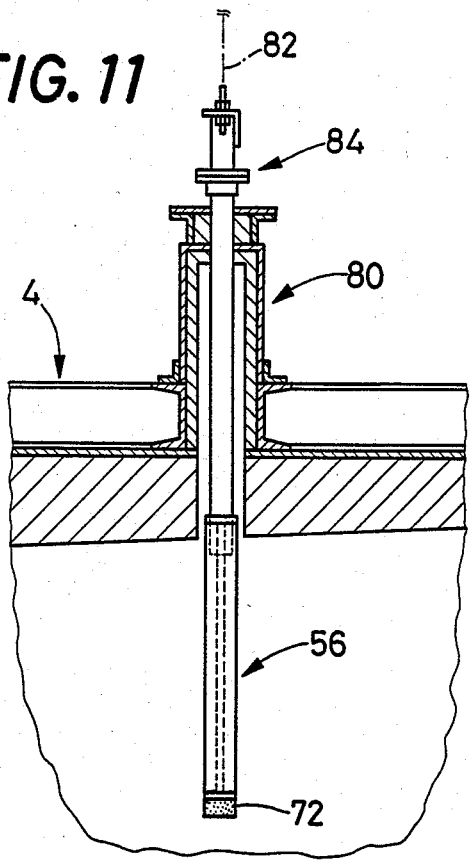

METHOD AND APPARATUS FOR MELTING METAL INGOTS

BACKGROUND OF THE INVENTION

The present invention relates in general to a method and an apparatus for melting metal ingots, so-called "pig", and more particularly to such method and apparatus wherein a charge material, e.g., a metal ingot pile consisting of a plurality of horizontal arrays of metal ingots superposed on each other, is introduced into a vertically extending melting chamber, and melted therein.

In the art of melting apparatus having a vertically extending melting chamber for melting metal ingots, there has been known a vertical melting furnace which is usually referred to as a "tower melter". As disclosed in journals "Al-Aru", pages 27–32 (March, 1982), and "MODERN METALS", Vol. 38, No. 11, P76 (1982), such melting apparatus commonly includes a vertically extending columnar melting furnace having a top lid closing its upper open end. Metal ingot piles or blocks each consisting of plural metal ingots superposed on each other in a stack are introduced through the upper open end of the melting furnace, by use of suitable loading or charging equipment. The introduced piles of metal ingots are pre-heated while they are gradually lowered in to the furnace, and are melted under heat by burners provided in the lower part of the furnace. The thus obtained molten metal is reserved in a reservoir which communicates with the lower part of the furnace.

In such a vertical melting furnace, the piles of metal ingots introduced in the furnace through its top opening are moved downward as the previously introduced lower piles are melted by the burners. While the metal ingot piles are lowered, they are pre-heated by exhaust gases of the burners flowing upward through the charged furnace. Consequently, the piles of metal ingots which have descended down to the lower part of the furnace become more or less molten, and may be readily melted by the burners.

In this type of melting apparatus wherein the metal ingot piles are directly dropped into a vertical furnace through its upper open end, however, the introduced metal ingot piles may frequently be caught or suspended halfway or part way through the furnace. This phenomenon may easily happen, particularly because the metal ingots are piled in such manner that the pile is difficult to collapse sideways or in lateral directions. If the metal ingot piles remain halfway through the falling distance in the furnace, the flames of the burners will not reach the metal ingots of the suspended piles. Further, these ingots are not sufficiently heated by the exhaust gases of the burners. In this case, therefore, extra heating time is required for melting those metal ingots, and the melting efficiency or economy is reduced.

Moreover, the above-described manner of charging the vertical melting furnace with metal ingot piles will not permit the metal ingots in each pile to be sufficiently separated from each other and evenly distributed within the furnace. In other words, the metal ingots dropped into the furnace tend to remain in a piled or stacked condition. As a result, there exist spaces or voids between the inner wall surface of the furnace and the metal ingot piles. In this state, the exhaust gases blow upward through such voids. This may reduce the efficiency of heat transfer from the exhaust gases to the metal ingots, and cause local melting of the ingots in the pre-heating portion of the furnace, resulting in increased possibility of local blow of the exhaust gases. The exhaust gas blow and consequent localization of the exhaust gas flow has an adverse effect on the pre-heating efficiency of the metal ingots during their downward movement. Further, the melting of the metal ingots in the pre-heating zone of the furnace which is distant from the lower reservoir, will cause oxidization of the molten metal, with an unfavourable result of increasing an amount of dross in the melt.

Another type of melting apparatus for piles of metal ingots is known as a high-speed melting furnace in which the piles of metal ingots are moved in succession through a horizontally extending channel, and melted by burners at the end of the channel. The molten metal is dripped down into a lower dry hearth, through an opening which is formed through the bottom wall of the melting chamber. The molten metal poured in the dry hearth is then led into a reservoir. In this type of melting furnace, the metal melt is dripped a relatively long distance from the upper melting chamber down to the lower dry hearth, and is therefore subject to considerable thermal loss as well as unit loss due to oxidization. Consequently, it is necessary to heat the molten metal in the dry hearth before it is led into the reservoir. Thus, the known high-speed melting furnace is disadvantageous in terms of heating efficiency and cost of heating equipment.

For improved melting efficiency in the above-described type of high-speed melting furnace, it is essential that the metal ingot material moved to the melting end of the melting chamber be melted while both solid and liquid pahses coexist at equilibrium, before the melt is poured down through the opening in the melting portion. However, it is very difficult to maintain such conditions, in view of the possibility of changes in the charge material and configuration of the charge material (metal ingots). In the case of aluminum ingots, the range of temperature at which solid and liquid phases may coexist is relatively narrow. Namely, the aluminum ingot is melted progressively from its outer portion. Hence, the application of the conventional high-speed melting furnace to aluminum ingots is extremely difficult.

SUMMARY OF THE INVENTION

It is therefore an object of the present invention to provide a method and an apparatus suitable for melting piles of metal ingots, particularly of aluminum or its alloy, in a vertically extending melting chamber, which method and apparatus permit effective collapse of the piles of metal ingots upon introduction thereof into the melting chamber, which suffer minimum suspension of the piles part way through the melting chamber, and minimum exhaust gas blow, and which allow maximum efficiency of energy utilization for melting of the introduced ingots.

According to the invention, there is provided a method of melting metal ingots, comprising the steps of: preparing a pile of elongate metal ingots each of which has a generally rectangular shape, the pile consisting of plural horizontal arrays of the metal ingots superposed on each other; pre-heating the pile of metal ingots in a substantially horizontal pre-heating chamber while the pile is moved from one end of the pre-heating chamber toward the other end thereof; pushing the pre-heated pile of metal ingots at the above-indicated other end of the pre-heating chamber into a melting chamber which communicates with the pre-heating chamber at said other end thereof and extends vertically downwardly from said other end of the pre-heating chamber, and thereby causing the pile of metal ingots to be turned substantially sideways and fall through the melting chamber with a result of collapse of the pile into the individual metal ingots in the melting chamber; and melting the metal ingots in the melting chamber with burner means.

According to the method of the invention described above, the piles of metal ingots moved in succession horizontally in the pre-heating chamber are pre-heated by high-temperature exhaust gases fed from the melting chamber, and the leading pile of metal ingots is pushed by means of forward movements of the following piles, into the melting chamber through its open end adjacent to the front end of the pre-heating chamber, whereby the pushed pile is turned substantially sideways and fall down into the melting chamber. With the metal ingot pile turned sideways, the individual ingots of the pile are easily separated from each other and evenly distributed or scattered over a wider area in the melting chamber. Accordingly, there are less chances that the metal ingots may remain in pile or be suspended midway or part way through a falling distance in the melting chamber, which may cause comparatively large voids between the inner wall of the melting chamber and the ingots. Thus, the instant method is effective in preventing the conventionally experienced exhaust gas blow through such voids.

Since the metal ingots which existed in piles in the pre-heating chamber are scattered or distributed over a wider area in the melting chamber, the overall heat exchange surface area of the introduced metal ingots is increased, and consequently the efficiency of utilization of thermal energy input to the burner means is improved. In addition, the effective restraint of exhaust gas blow contributes to prevention of local melting of the metal ingot piles (metal ingots), which in turn contributes to reduction in amount of dross (oxidation loss) of the molten metal.

The above-described method according to the invention may be suitably practiced by a melting apparatus which is constructed according to the invention. The instant melting apparatus comprises:

(a) a pre-heating chamber extending substantially horizontally for accommodating a series of piles of elongate metal ingots each of which has a generally rectangular shape, each of the plurality of piles consisting of a plurality of horizontal arrays of the metal ingots superposed on each other, the plurality of piles being pre-heated in the pre-heating chamber while the piles are moved from one end of the pre-heating chamber to the other end;

(b) a melting chamber which is open at an upper end thereof in a portion of a bottom wall of the pre-heating chamber at said other end thereof and extends vertically downwardly from said other end of the pre-heating chamber, the melting chamber comprising a shaft portion which has a generally oblong transverse cross sectional shape, said shaft portion having burner means at a lower part thereof, a dimension of the generally oblong transverse cross sectional shape of the shaft portion in a direction along a line of extension of the pre-heating chamber being larger than that in a direction perpendicular to said line of extension, the pre-heated pile of metal ingots which has been moved to said other end of the pre-heating chamber being pushed into the shaft portion, and thereby turned substantially sideways before falling down into the lower part of the melting chamber in which the metal ingots of the pushed pile are melted by the burner means; and (c) a reservoir chamber communicating with a lower end of the melting chamber and extending therefrom substantially horizontally, the reservoir chamber storing a mass of molten metal obtained by means of melting of the metal ingots in the melting chamber.

According to a preferred embodiment of the apparatus of the invention, the generally oblong transverse cross sectional shape of the shaft portion of the melting chamber is defined by a pair of opposed symmetrical arcs, and a pair of opposed parallel straight lines which extend in the direction along the line of extension of the pre-heating chamber. For easy movement of the pushed plural piles of ingots in the pre-heating chamber, it is advantageous that the bottom wall of the pre-heating chamber is inclined downwardly toward the upper open end of the melting chamber.

According to another preferred embodiment of the apparatus of the invention, the dimension of the generally oblong transverse cross sectional shape (profile of the inner wall surface) of the shaft portion along the line of extension of the pre-heating chamber is larger than a length of a diagonal line which connects a front upper corner and a rear lower corner in vertical cross section of each pile of metal ingots. This arrangement facilitates the sideways turning of the metal ingot pile.

Generally, it is advantageous to construct the pre-heating chamber so that it has a substantially rectangular transverse cross sectional shape, as the metal ingots are usually piled in the form of a cube or rectangular parallepiped when viewed as a whole. Preferably, the pre-heating chamber is provided with an exhaust outlet in a portion of a side wall adjacent to its inlet end, so that exhaust gases produced in the melting chamber may be led into the pre-heating chamber and discharged through the exhaust outlet. In this instance, the piles of metal ingots accommodated within the pre-heating chamber are effectively pre-heated by the positive flows of the exhaust gases through the pre-heating chamber.

According to a still further advantageous embodiment of the invention, the melting apparatus further comprises damper means having at least one damper member which is movable between its retracted, and its operated position at which the damper member closes a space between an inner wall surface of the pre-heating chamber and a surface of the pile of metal ingots opposite to the inner wall surface of the pre-heating chamber. In this case, the damper member intercepts flows of exhaust gases from the melting chamber through the space between the inner wall surface of the pre-heating chamber and the opposite surface of the ingot pile.

In one form of the above embodiment, the damper means includes a ceiling damper unit having a damper member which protrudes from a ceiling wall of the pre-heating chamber toward the pile of metal ingots when the damper member is moved from its retracted position to its operated position.

In another form, the damper means includes at least one side damper unit disposed on at least one of opposite side walls of the pre-heating chamber. Each side damper unit has a damper member which protrudes from the corresponding side wall toward the metal ingot pile when the damper member is moved toward the operated position.

In accordance with an advangateous form of the melting appratus, the damper means comprises both a ceiling damper unit and at least one side damper unit as indicated above. In this instance, the damper members of the ceiling damper unit and the side damper unit are spaced from each other in the direction along the line of extension of the pre-heating chamber.

According to another aspect of the invention, there is also provided an apparatus for melting a mass of metallic material substantially in the form of a rectangular parallelepiped, comprising: a melting chamber for melting the mass of metallic material directly by burner means; a pre-heating chamber which extends substantially horizontally, and through which the mass of metallic material is moved from one end thereof to the other end on the side of the melting chamber, high-temperature exhaust gases being led from the melting chamber into the pre-heating chamber to pre-heat the mass of metallic material to a predetermined temperature prior to melting thereof by the burner means; and damper means having at least one damper member which is movable between its retracted position, and its operated position at which the damper member closes a space between an inner wall surface of the pre-heating chamber and a surface of the pile of metal ingots opposite to the inner wall surface, thereby intercepts flows of the exhaust gases through the above-indicated space.

BRIEF DESCRIPTION OF THE DRAWING

The foregoing and other objects, features and advantages of the invention will be understood by referring to the following detailed description, taken in connection with the accompanying drawing, wherein:

FIGS. 8 and 9 are views taken along lines VIII—VIII and IX—IX of FIG. 7, respectively;

FIG. 11 is a view taken along line X—X of FIG. 10;

DETAILED DESCRIPTION OF THE PREFERRED EMBODIMENTS

To further clarify the concept of the present invention, preferred embodiments of a method of the invention and of an apparatus to practice the method will be described in detail, referring to the accompanying drawings.

Figure 1:
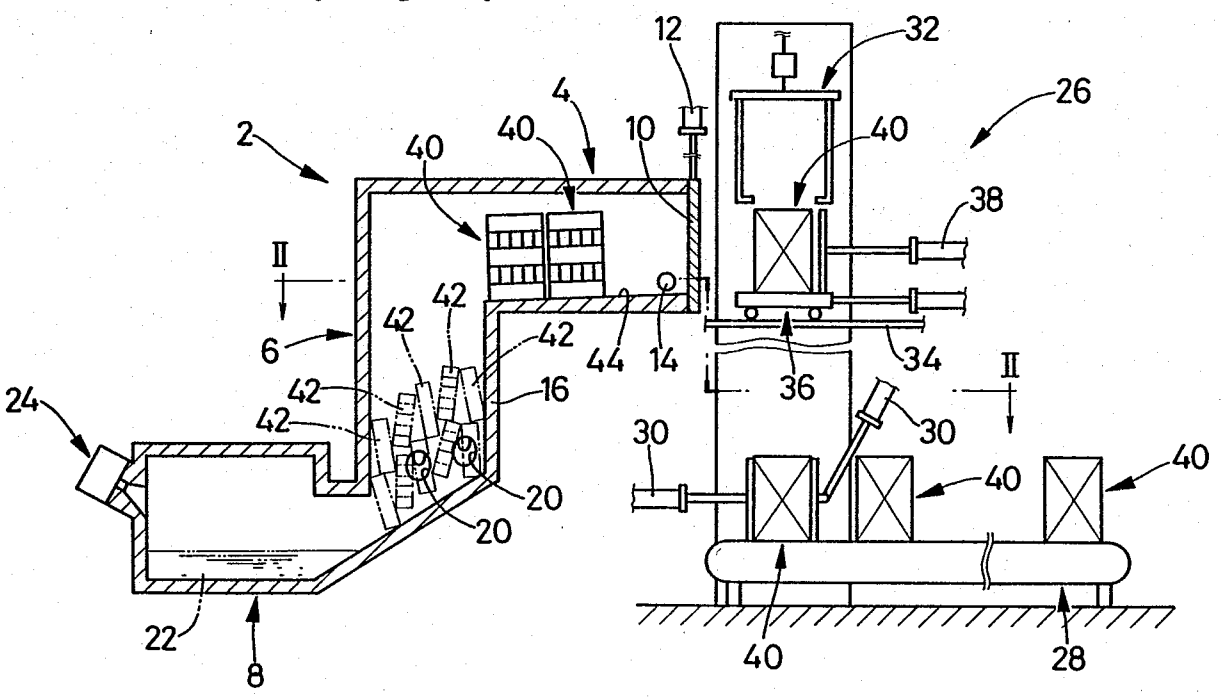
FIG. 1 is a schematic front elevational view, partly in cross section, of a melting apparatus suitable for implementing the concept of the present invention.
Figure 2:
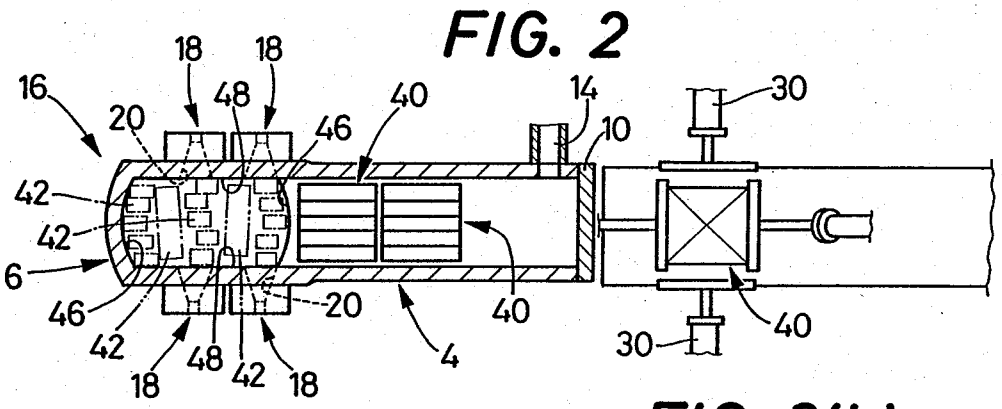
FIG. 2 is a schematic view partly in cross section taken along line II—II of FIG. 1.

Referring first to FIGS. 1 and 2, there is shown a melting apparatus 2 according to the invention which comprises: a pre-heating chamber 4 which extends horizontally; a melting chamber 6 which is open at its upper end in the front end of a bottom wall 44 of the pre-heating chamber 4 and extends vertically downwardly from the bottom wall 44 of the pre-heating chamber 4; and a reservoir chamber 8 which communicates with the lower end of the melting chamber 6 and extends horizontally from the lower end of the melting chamber 6. The pre-heating chamber 4 is provided with a charging door 10 which is moved by a cylinder 12 between its upper and lower positions to close an entrance of the pre-heating chamber 4 when in the lower position. In a lower portion of a side wall adjacent to the entrance of the pre-heating chamber 4, there is formed an exhaust outlet through which exhaust gases from the melting chamber 6 are discharged.

The melting chamber 6 includes a shaft portion 16 (charging shaft) which has a generally oblong transverse cross sectional shape as indicated in FIG. 2. Two burner devices 18 are provided on each of opposite side walls at a lower part of the shaft portion 16, for melting metal ingots which have fallen into the lower part of the shaft portion 16. The burner devices 18 feed combustion flames or combustion gases into the lower or bottom part of the shaft portion 16 through burner channels 20 which are formed through the walls of the shaft portion 16 such that the channels 20 are inclined downward in the direction from the burner devices 18 toward the interior of the shaft portion 16. The metal ingots in the lower part of the shaft portion 16 are exposed to the combustion flames or combustion exhaust gases introduced through the burner channels 20.

Molten metal 22 obtained in the melting chamber 6 flows into the reservoir chamber 8 for storage therein. The reservoir chamber 8 has a burner device 24 for maintaining the molten metal 22 at a predetermined elevated temperature.

Adjacent to the entrance of the pre-heating chamber 4, there is disposed ingot loading or charging equipment 26 which includes a slat conveyor 28, a rectifying device 30, a lifting device 32, a truck 36 which is movable close to the entrance of the pre-heating chamber 4 while being supported and guided by rails 34, and a pusher device 38. In this loading equipment 26, a pile 40 of metal ingots 42 (which will be described) to be introduced into the melting apparatus 2 is first placed on the slat conveyor 28 by a forklift truck or other suitable lifting means, and transported by the slat conveyor 28 to a predetermined lifting position from which the pile 40 is lifted by the lifting device 32. Before the pile 40 is lifted by the lifting device 32, the pile 40 at the lifting position on the slat conveyor 28 is rectified by the rectifying device 30, to recover the original orderly form of the pile 40, which may be lost to some degree during its transportation. The rectified pile 40 is then lifted by the lifting device 32 and mounted on the truck 36. The truck 36 and the pile 40 mounted thereon are pushed by the pusher device 38 close to the entrance of the pre-heating chamber 4. After the charging door 10 is opened, the pile 40 is further pushed by the pusher device 38 into the pre-heating chamber 4.

Figure 3B:
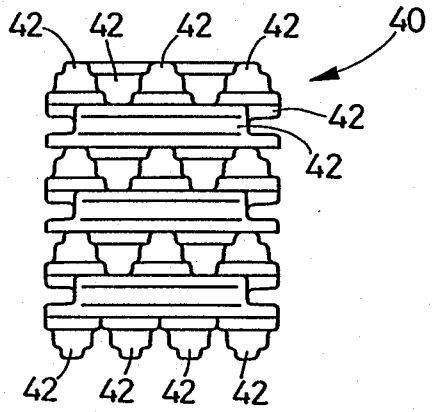
FIGS. 3(*a*) and 3(*b*) are plan and side elevational views, respectively, of a pile of metal ingots.
Figure 3A:
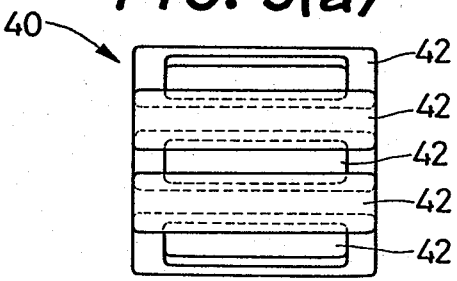

The pile 40 of metal ingots 42 which is introduced into the pre-heating chamber 4 of the melting apparatus 2 in the manner as discussed above, consists of a plurality of horizontal arrays of the metal ingots 42 which are superposed on each other. For example, as illustrated in FIGS. 3(*a*) and 3(*b*), each pile 40 consists of six horizontal arrays of elongate metal ingots 42 (six horizontal arrays except the lowermost array of four ingots 42). The individual horizontal arrays of the elongate metal ingots 42 are stacked such that the ingots 42 of one of the arrays are substantially perpendicular to those of the adjacent array or arrays. More specifically, the elongate metal ingots 42 of the first, third and fifth arrays from the top of the pile 40 are arranged so as to extend in one direction, while those of the second, fourth and sixth arrays extend in a direction perpendicular to the above-identified one direction.

Figure 4A:
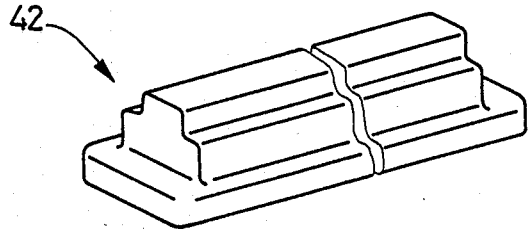
FIG. 4(*a*) is a perspective view of a metal ingot, and FIGS. 4(*b*) and 4(*c*) are transverse and longitudinal cross sectional views of the metal ingot, respectively.
Figure 4B:
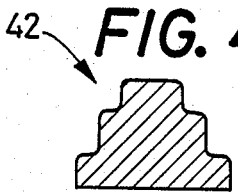
Figure 4C:
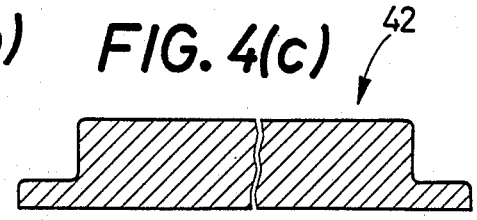
Figure 5A:
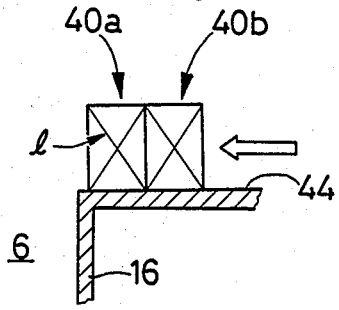
FIGS. 5(*a*) through 5(*d*) are illustrations showing a process in which piles of metal ingots are moved forward in a pre-heating chamber of the apparatus, and the leading pile is turned sideways and falls into a melting chamber of the apparatus.
Figure 5B:
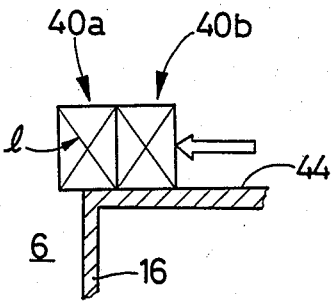
Figure 5C:
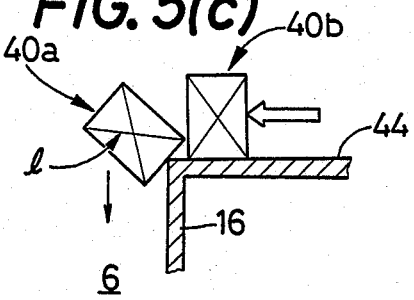
Figure 5D:
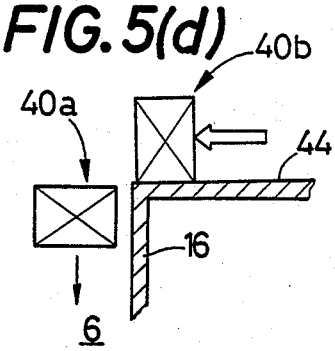

Each of the elongate metal ingots 42 has symmetrical stepped parallel sides, namely each ingot 42 is generally trapezoidal in transverse cross section over a substantial length thereof, as indicated in FIGS. 4(*a*), 4(*b*) and 4(*c*). As shown in FIG. 3(*b*), each of the six horizontal arrays consists of the elongate metal ingots 42 which stand upright, and the elongate metal ingots 42 which are inverted. These upright and inverted ingots 42 are arranged alternately in parallel and in abutting contact with each other. In the top array, for example, the inverted ingots are sandwiched on its opposite stepped lateral sides by the adjacent upright ingots.

The metal ingots 42 are generally referred to as "pig", which is an oblong or elongate mass of metal a typical transverse cross sectional shape is as shown in FIGS. 3(*a*)–(*b*) and 4(*a*)–(*c*). However, these ingots 42 may have a rectangular shape in transverse cross section. While the manner of arrangement of the metal ingots 42 in pile is illustrated herein by way of example only, the metal ingots 42 may be piled in any other suitable manners, provided that a pile consists of a plurality of horizontal arrays of the metal ingots 42 which are stacked on each other. In the instant specific embodiment, the metal ingots 42 are made of aluminum or its alloys.

The piles 40 of the metal ingots 42 are pushed end to end one after another by the pusher device 38 into the pre-heating chamber 4, as shown in FIG. 1. More specifically described, each time a new pile 40 is pushed in, the piles 40 already located in succession in the pre-heating chamber 4 are slid forward on the bottom wall 44 toward its front end by a distance equal to the operating stroke of the pusher device 38 (equal to a width of the piles 42). With the piles 40 pushed end to end into the pre-heating chamber 4 in this way, the leading pile 40 reaches the front end of the pre-heating chamber 4. While the piles 40 of the metal ingots 42 are moved in the pre-heating chamber 4 from its entrance toward its front end at which the melting chamber 6 is open at its upper end, the metal ingots 42 of each pile 40 are preheated by exhaust gases of elevated temperature which are led from the melting chamber 6 and flow through the pre-heating chamber 4. As a result, the metal ingots 42 become molten in a considerable degree, or become easy to be melted, until the pile 40 reaches the front end of the pre-heating chamber 4.

In the instant embodiment, the bottom wall 44 of the pre-heating chamber 4 is inclined downwardly in the direction toward its front end in which the melting chamber 6 is open. This inclination of the bottom wall 44 facilitates the sliding forward movements of the individual piles 40 through the pre-heating chamber 4. Further, the pre-heating chamber 4 is constructed with substantially rectangular transverse cross sectional shape on the inner side, so that the piles 40 are evenly exposed to the flows of the exhaust gases. The provision of the exhaust outlet 14 adjacent to the entrance of the pre-heating chamber 14 induces positive flow of the exhaust gases from the melting chamber 6 into the pre-heating chamber 4 and toward its entrance, thereby permitting effective utlization of thermal energy of the hot exhaust gases.

The ingot piles 40 which are pre-heated in the pre-heating chamber 4 during their movements, are pushed to fall from the pre-heating chamber 4 into the melting chamber 6, more precisely, into the shaft portion 16 of the chamber 6. Namely, the leading pile 40 at the front end of the bottom wall 44 is pushed forward by the following piles 40, and turned substantially sideways. Thus, the pile 40 falls down in the sideways turned posture.

FIGS. 5(*a*) through 5(*d*) illustrate the above indicated process, that is, the forward movements of the ingot piles 40 within the pre-heating chamber 4 toward its front end, and the change of posture of the leading pile 40 when it is pushed to fall from the front end of the pre-heating chamber 4 into the melting chamber 6.

Stated in more detail, FIG. 5(*a*) shows the leading pile 40*a* (which is dropped next in the melting chamber 6) which has been moved to the front end of the pre-heating chamber 4 and has been heated to an elevated temperature, and the pile 40*b* which follows the pile 40*a*. (The piles 40 following the pile 40*b* are not shown.) When the charging door 10 is opened in this condition and the new pile 40 is pushed into the pre-heating chamber 4 by the pusher device 38, the piles 40 (including the piles 40*a* and 40*b*) already located within the pre-heating chamber 4 are pushed forward. Hence, the leading pile 40*a* is pushed forward by the following pile 40*b* as shown in FIG. 5(*b*). As the new pile 40 is pushed further, the leading pile 40*a* is moved forward a further distance, whereby the area of the bottom surface of the pile 40*a*, which is supported by the bottom surface 44, is reduced gradually, and the pile 40*a* starts falling while turning counterclockwise (in the figures). Finally, the leading pile 40*a* has been turned substantially sideways as illustrated in FIG. 5(*d*), and falls down into the melting chamber 6.

With the pile 40 falling down in this substantially turned posture, the pile 40 easily collapses or breaks into the individual ingots 42. Thus, the individual ingots 42 are separated from each other and are scattered over a comparatively large area in the melting chamber 6, as indicated in FIG. 1. It is noted in this connection, that the pile 40 formed of a plurality of vertically stacked arrays of the metal ingots 42 is very difficult to break or collapse by vertical forces, but extremely easy to collapse by horizontal or lateral forces (as will be understood by reference to FIG. 3).

Since the metal ingots 42 are scattered in the melting chamber 6 owing to the fall of the pile 40 in its turned posture, the conventionally encountered problem that piles of ingots are kept caught or suspended midway or part way through the falling distance in the melting chamber 6 is ameliorated. In other words, the scattered metal ingots 42 may be effectively heated and melted with combustion flames or combustion exhaust gases from the burner devices 18. Further, the above method of introducing the pile 40 into the melting chamber 6 provides an effective solution to conventionally experienced formation of relatively large voids between the inner wall surfaces of the melting chamber 6 and the surfaces of the ingot pile, thereby eliminating the consequent blow of the exhaust gases through the voids. Therefore, the input energy used by the burner devices 18 may be efficiently utilized for heating and melting the metal ingots 42. The elimination of the exhaust gas blow means the absence of local melting of the pile 40, which results in minimization of the dross that is produced.

The oblong transverse cross sectional shape (profile of inner wall surface) of the shaft portion 16 of the melting chamber 6 in the illustrated embodiment, is defined by a pair of opposed symmetrical arcs 46, and a pair of parallel straight lines 48 which extend along the length (along the line of extension) of the pre-heating chamber 4 so as to connect the ends of the symmetrical arcs 46, as shown in FIG. 2. In this construction, the strength of the shaft portion 16 is increased. Moreover, the transverse cross sectional shape of the shaft portion 16 (melting chamber 6) is oblong in the direction along the length of the pre-heating chamber 4, that is, the dimension of the transverse cross sectional shape of the melting chamber 6 in the direction along the length of the pre-heating chamber 5 is larger than the dimension in the direction along the width of the pre-heating chamber 4. This arrangement facilitates the falling of the ingot piles 40 in their turned posture, which in turn facilitates the collapse of the piles. In addition, the oblong configuration of the shaft portion 16 serves to effectively prevent exhaust gas blows in the direction of width, thus making it possible to improve the utilization or reclamation of the thermal energy, viz., for better flow of the exhaust gases from the melting chamber 6 into the pre-heating chamber 4.

Generally, the melting chamber 6 is charged with a plurality of ingot piles 40 (metal ingots 42 obtained from a plurality of piles). The metal ingots 42 are melted progressively, beginning with the ingots 42 located in the bottom portion of the shaft portion 16. The metal ingots 42 in the relatively upper portion of the shaft portion 16 are heated by exhaust gases which flow between the ingots.

The oblong transverse cross sectional configuration of the shaft portion 16 (melting chamber 6) is not limited to that of the illustrated embodiment. For example, the configuration may be oval, ellipzoidal, rectangular, or of other oblong shape. The dimension of the transverse cross section of the shaft portion 16 along the length of the pre-heating portion 4 is preferably larger than the length [l indicated in FIGS. 5(*a*) and 5(*b*)] of a diagonal line which connects the front upper corner and the rear lower corner in vertical cross section of the pile 40, so that the pile 40 may more easily fall down into the shaft portion 16.

The molten metal 22 which is obtained by melting the metal ingots 42 in the melting chamber 6 flows down on the inclined bottom surface of the melting chamber 6, and kept in store in the reservoir chamber 8. The mass of molten metal 22 in the reservoir chamber 8 is maintained at a predetermined temperature by the burner device 24.

Figure 6:
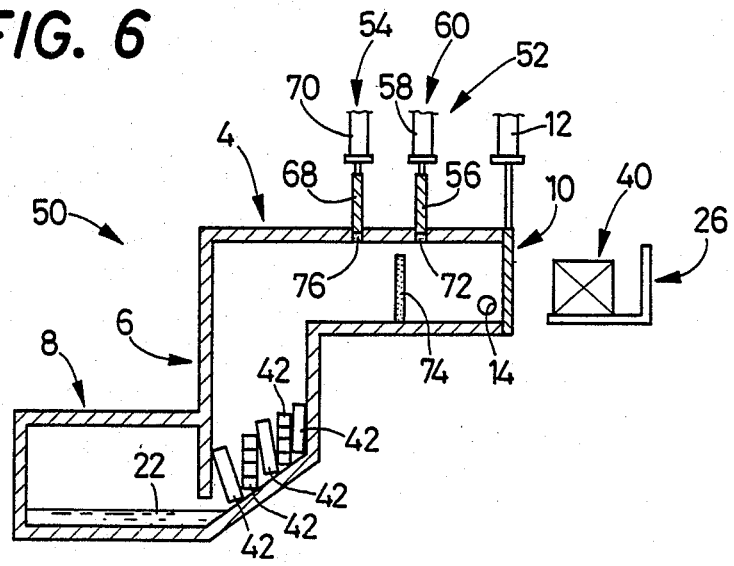
FIG. 6 is a schematic front elevational view in cross section of another embodiment of the melting apparatus of the invention.

Referring next to FIGS. 6–9, another embodiment of the invention will be described. A melting apparatus generally indicated at 50 in FIG. 6 is similar to the melting apparatus 2 of the preceding embodiment, with the exception that the pre-heating chamber 4 of the instant embodiment is provided with damper means which will be described in detail. In the interest of brevity and simplification, the same reference numerals as used in FIGS. 1–5 are used in FIGS. 6–9 to identify the corresponding components, and repeated detailed description of such components is omitted herein.

Figure 7:
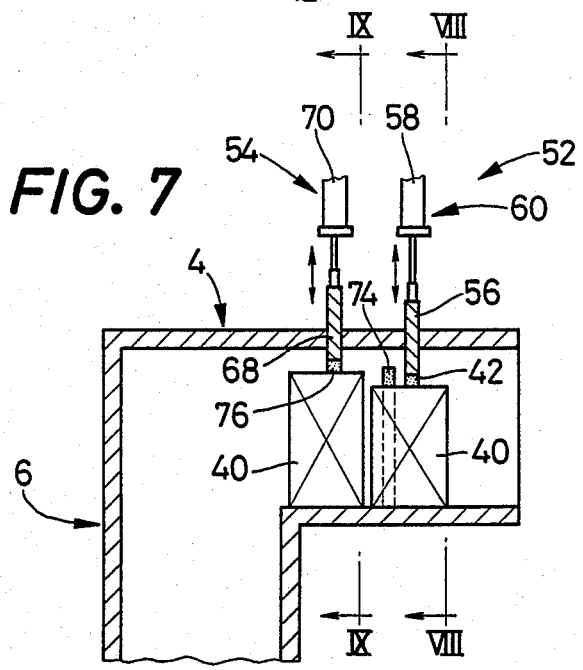
FIG. 7 is an enlarged view of a pre-heating chamber of the apparatus of FIG. 6 at which damper devices are provided.

In FIG. 6, there are shown a first damper device 52 and a second damper device 54 which are provided on the pre-heating chamber 4. The first damper device 52 includes a ceiling damper unit 60 comprising a heat-resistant damper plate 56 and a cylinder 58. The damper plate 56 is disposed so as to penetrate the ceiling wall of the pre-heating chamber 4, and is movable up and down by the cylinder 58 between its retracted position of FIG. 6, and its operated position of FIG. 7. The first damper device 52 further includes a pair of side damper units 66, 66 provided on opposite side walls of the pre-heating chamber 4, as most clearly shown in FIG. 8. The side damper units 66, 66 comprise opposide heat-resistant damper plates 62, 62 similar to the damper plate 56. The side damper plates 62, 62 are disposed so as to penetrate the corresponding opposite side walls of the pre-heating chamber 4 toward each other. The two damper plates 62, 62 are movable by respective cylinders 64, 64 toward and away from each other, between their retracted position adjacent to the side walls of the pre-heating chamber 4, and their operated position on the side of the interior of the chamber 4. As indicated in FIG. 7, the side damper units 66, 66 are located a small distance away from the ceiling damper unit 60 in the direction of length of the pre-heating chamber 4, i.e., in the direction in which the metallic material 40 is moved.

The second damper device 54 is located a suitable distance away from the first damper device 52 in the direction of extension of the pre-heating chamber 4. Like the ceiling damper unit 60 of the first damper device 52, this second damper device 54 includes a damper plate 68 which extends through the ceiling wall of the pre-heating chamber 4 and is movable by a cylinder 70 between its retracted position of FIG. 6 and its operated position of FIG. 7.

In operation of the above-constructed damper devices 52, 54 provided for the pre-heating chamber 4 into which the ingot pile 40 are loaded successively by the loading equipment 26 for pre-heating by the high-temperature exahust gases from the melting chamber 6, the spaces between the pile 40 and the inner wall surfaces of the pre-heating chamber 4 are closed or blocked by the damper devices 52, 54. That is, the first and second damper devices 52, 54 effectively intercept the exhaust gases which would otherwise flow straight through the space between the top surface of the ingot pile 40 and the ceiling surface of the pre-heating chamber 4, and through the spaces between the side surfaces of the pile 40 and the opposite inner side wall surfaces of the pre-heating chamber 4.

Described in greater detail, the damper plates 56, 62, 62, 68 of the damper devices 52, 54 are moved to their operated positions towarad the pile 40 by the appropriate cylinders 58, 64, 64, 70, so as to close the spaces between the inner wall surfaces of the pre-heating chamber 4 and the exposed surfaces of the material mass 16, thereby preventing the exhaust gases from passing through such otherwise existing spaces, and from being fed directly (straightly) toward the exhaust outlet 14.

As a result, the contact of the high-temperature exhaust gases with the ingot pile 40 may be achieved more effectively in the pre-heating chamber 4, whereby the pre-heating efficiency (heat exchanging efficiency) may be considerably increased.

Stated differently, the straight flow of the exhaust gases through the pre-heating chamber 4 is blocked by the damper plates 56, 62, 62, 68, and consequently the exhaust gases are forced to flow in a zigzag or meandering manner through passages which are not closed by the damper plates in the pre-heating chamber, resulting in an increased probability of contact of the gases with the ingot pile 40, thus improving the heat exchanging efficiency between the exhaust gases and the pile 40.

Since the damper plates 56, 62, 62, 68 of the first damper device 52 (60, 66, 66) and the second damper device 54 are adjustable in operating distance by the corresponding cylinders 58, 64, 64, 70, it is possible to accomplish the intended tight closure of the spaces between the ingot pile 40 and the inner wall surfaces of the pre-heating chamber 4, even if the dimensions of the ingot pile 40 is changed, i.e., even if the distances between the top and side surfaces of the pile 40 and the opposite wall surfaces of the pre-heating chamber 4 are changed, as illustrated in FIG. 7, due to change of the pile 40 from one lot to another. Namely, the damper plates 56, 62, 62, 68 are moved by the cylinders 58, 64, 64, 47 until their ends are brought into pressed contact with the corresponding sides of the ingot pile 40. Obviously, the provisions are made for keeping the contact pressure constant irrespective of the change in the size of the ingot pile 40.

When the ingot pile 40 in the pre-heating chamber 4 are moved forward upon loading of another ingot pile 40 into the pre-heating chamber 4 through its entrance by the loading equipment 26, the damper plates 56, 62, 62, 68 of the damper devices 52, 54 are retracted outwardly away from the appropriate pile 40, in order to protect the damper devices 52, 54 from damage due to interference with the pile 40. It is noted, in this connection, that the loading movements of the loading equipment 26 are controlled in synchronization with the outward retracting movements of the damper plates 56, 62, 62, 68 before loading of the new pile 40 by the loading equipment 26, and with the inward advancing movements of the damper plates after the forward movements of the already introduced pile 40 and the newly introduced pile 40.

For minimizing the gaps between the pile 40 and the ends of the damper plates 56, 62, 62, 68 of the damper devices 52, 54, the damper plates are provided at their ends with heat-resistant cushioning portions 72, 74, 74, 76 of suitable thickness.

The form of a charge material which is introduced into the pre-heating chamber 4 of the melting apparatus 50, is not limited to a pile of a plurality of ingots, but may take any form of suitable dimensions provided the form is substantially a cube or rectangular parallelepiped. It is preferred, however, that the charge material be in the form of a pile which consists of a plurality of horizontal arrays of metal ingots which are superposed on each other, as illustrated in FIGS. 3(*a*) and 3(*b*) and as described previously.

FIGS. 10–13 illustrate modified forms of the ceiling and side damper units 60, 66 of the damper device 52 (54).

Figure 10:
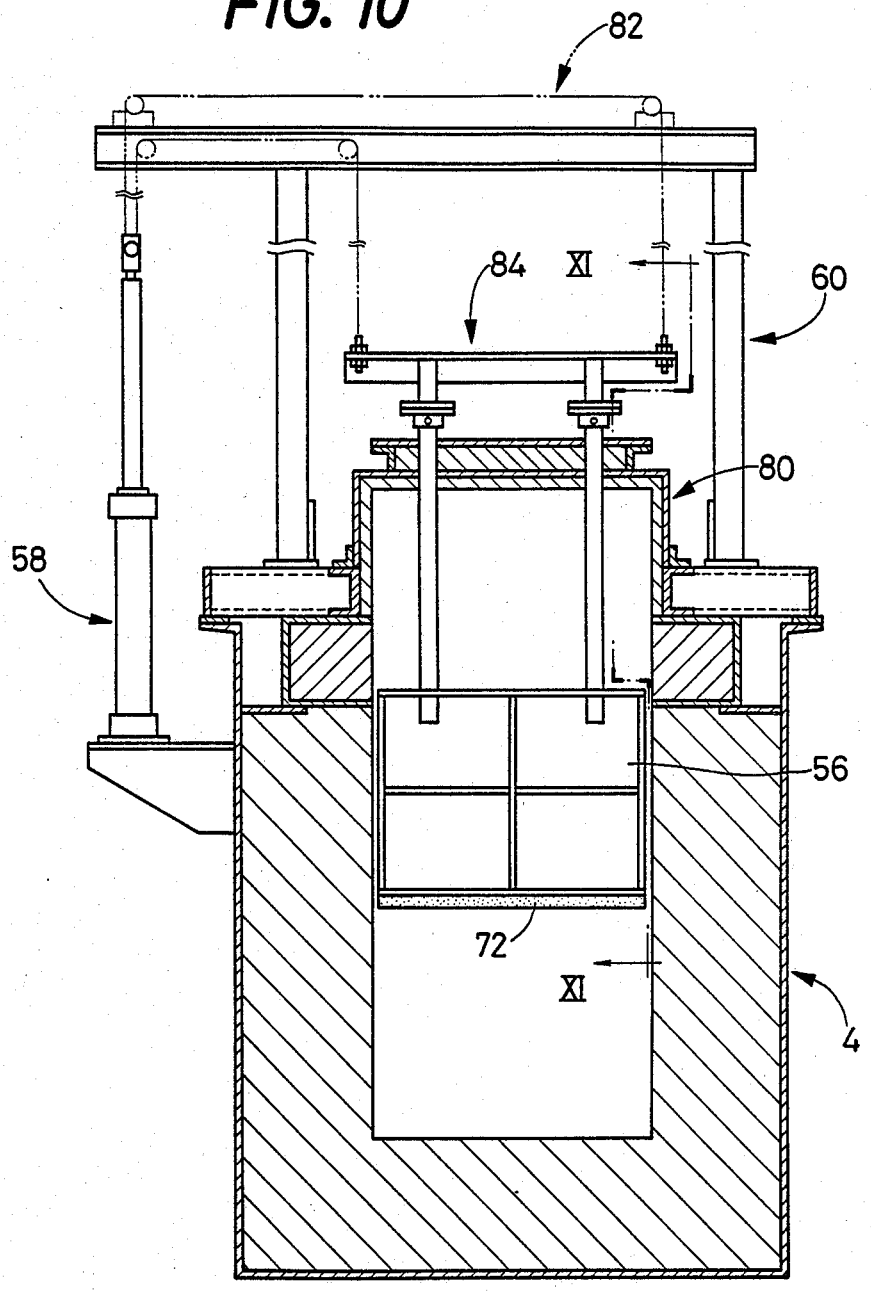
FIG. 10 is a view in transverse cross section of a pre-heating chamber and a ceiling damper unit of a modified embodiment of the invention.

The ceiling damper 60 shown in FIGS. 10 and 11 includes a damper casing 80 which is attached fluid-tightly to the pre-heating chamber 4. The damper plate 56 is accommodated in this damper casing 80 when it is located in its upper retracted position. The damper plate 56 is secured to an elevator frame 84 which is moved up and down by the cylinder 58 through wires 82. With the elevator frame 84 moved up and down, the damper plate 56 having a width substantially equal to the width of the pre-heating chamber 4 is lifted and lowered between its retracted and operated positions.

Figure 12:
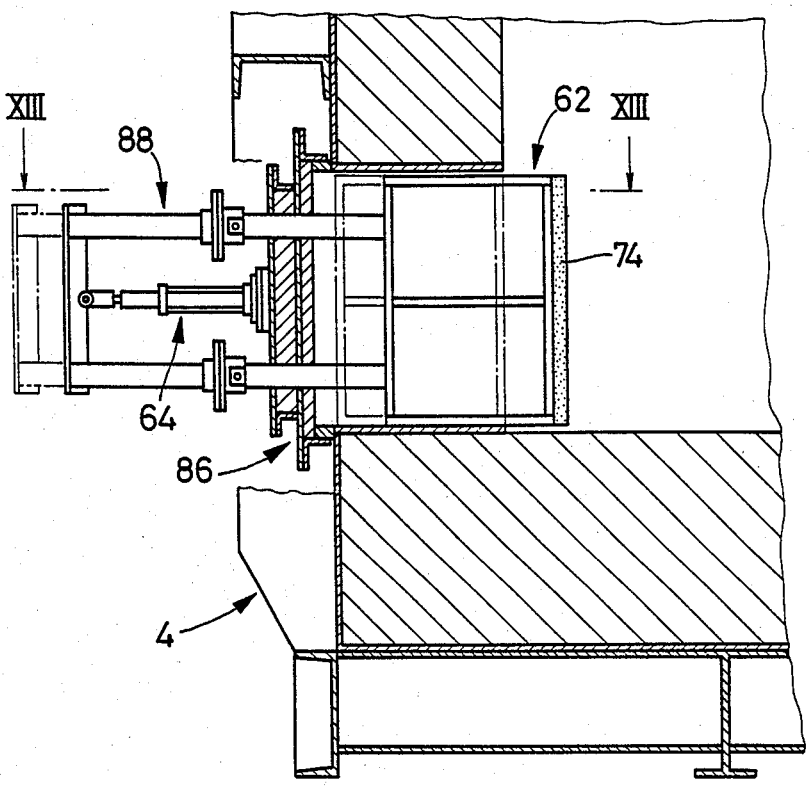
FIG. 12 is a fragmentary view of the pre-heating chamber in transverse cross section, illustrating a side damper unit used in another modified embodiment.
Figure 13:
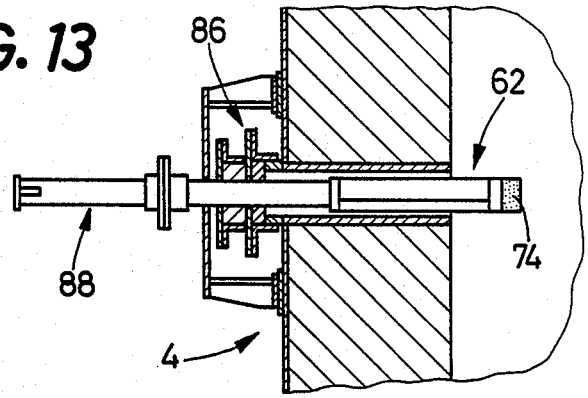
FIG. 13 is a view taken along line XIII—XIII of FIG. 12.

The side damper unit 66 shown in FIGS. 12 and 13 includes a damper casing 86 provided in the side wall of the pre-heating chamber 4. The damper plate 62 is accommodated in the damper casing 86 when it is located in its outer postion. The damper plate 62, which has a suitable height from the bottom wall of the pre-heating chamber 4, is secured to an actuator frame 58 which extends into the damper casing 86. With the actuator frame 88 moved right and left (in FIG. 12) by the cylinder 64, the damper plate 62 is moved horizontally between its retracted position in the damper casing 86 and its operated position in the pre-heating chamber 4. In the operated position, the damper plate 62 closes the space between the mass of metallic material 40 and the opposite side wall surface of the pre-heating chamber 4.

The horizontally extending pre-heating chamber 4 has provided an effective solution to the problem of short pass of the exhaust gases produced by melting of the metallic material. This problem has been difficult to solve in a conventional tower melter furnace in which a pre-heating zone is provided above a melting zone. It is appreciated to prevent the metallic material from being melted within the pre-heating chamber 4, and to completely avoid the short pass of the exhaust gases in the pre-heating chamber 4. To this end, it is preferred that the temperature of the exhaust gases from the melting chamber 6 be sensed at the front end of the pre-heating chamber 4, so as to control the temperature of the exhaust gases to be led into the pre-heating chamber 4, below a predetermined upper limit. In this case, the material mass 40 is newly introduced into the pre-heating chamber 4 to drop the material mass 40 at the front end of the chamber 4 into the melting chamber 6, when the sensed temperature of the exhaust gas has exceeded the predetermined upper limit.

While the illustrated melting apparatus 50 uses the first and second damper devices 52, 54 which are spaced apart in the direction of length of the pre-heating chamber 4, it is possible that a single damper device be provided at one position. Further, it is possible that a damper device be provided at three or more positions along the length of the pre-heating chamber 4. Moreover, the second damper device 54 which has only the ceiling damper unit (68, 70) in the illustrated embodiment, may be provided with side damper units similar to the units 66 as used in the first damper device 52.

The pre-heating chamber 4 according to the invention is preferably substantially rectangular in transverse cross section (inner wall profile), as in the illustrated embodiment, for ease of installation of the damper devices and for better closure of the spaces between the inner wall surfaces and the material mass 40. However, the pre-heating chamber 4 may take another transverse cross sectional shape. For example, the ceiling of the chamber 4 may take the form of an arch.

While the illustrated damper devices are suitably applicable to a melting apparatus having a horizontal pre-heating chamber which communicates with a melting chamber which extends vertically from the front end of the pre-heating chamber as in the illustrated embodiment, the damper devices according to the invention may be used in other types of melting apparatus which have a horizontally extending pre-heating chamber.

As described above, the damper devices are movable between their retracted and operated positions to close the spaces between the inner wall surfaces of the pre-heating chamber and a mass of metallic material, thereby intercepting otherwise possible straight flows of exhaust gases through such spaces. Thus, the contact of the exhaust gases with the metallic material is effectively accomplished, and the material is pre-heated with improved theremal efficiency.

While the present invention has been described in detail in its preferred embodiment, it is to be understood that the invention is by no means limited to the precise disclosure, but may be otherwise embodied with various changes, modifications and improvements that may occur to those skilled in the art, without departing from the spirit of the invention.

Although the present invention was developed particularly for melting piles of ingots of aluminum or its alloy, it will be obvious that the invention is equally applicable to the melting of other forms of other charge materials.

What is claimed is:

1. A method of melting metal ingots, comprising the steps of:

preparing a pile of elongate metal ingots each having a generally rectangular shape, said pile consisting of a plurality of horizontal arrays of the metal ingots superposed on each other;

pre-heating said pile of metal ingots in a substantially horizontally extending pre-heating chamber while said pile is moved from a first end of said pre-heating chamber toward a second end thereof;

pushing the pre-heated pile of metal ingots at said second end of the pre-heating chamber into a melting chamber which communicates with said pre-heating chamber at said second end thereof and extends vertically downwardly from said second end of the pre-heating chamber, thereby causing said pile of metal ingots to be turned substantially sideways and fall through said melting chamber, resulting in a collapse of the pile into individual metal ingots in said melting chamber; and melting the metal ingots in the melting chamber with a burner means.

2. A method as set forth in claim 1, wherein the elongate metal ingots in each of said plurality of horizontal arrays are substantially perpendicular to elongate metal ingots in an adjacent horizontal array.

3. A method as set forth in claim 1, wherein each of the metal ingots has a generally trapezoidal shape in transverse cross section at a midpoint thereof.

4. A method as set forth in claim 1, wherein said metal ingots comprise a material selected from the group consisting of aluminum and aluminum alloys.

5. An apparatus for melting metal ingots, comprising:

a pre-heating chamber having a first end and a second end and extending substantially horizontally for accomodating a plurality of piles of elongate metal ingots each of said piles having a generally rectangular shape, each of said plurality of piles consisting of a plurality of horizontal arrays of the metal ingots superposed on each other, said plurality of piles being pre-heated in said pre-heating chamber while said piles are moved from said first end of said pre-heating chamber toward said second end;

a melting chamber comprising a shaft portion having a generally oblong transverse cross sectional shape, said shaft portion having an opening at an upper first end thereof, said opening communicating with said second end of said pre-heating chamber, said melting chamber extending vertically downwardly from said second end of the pre-heating chamber and a burner means located at a lower second end of said vertically extending melting chamber, wherein, a dimension of said generally oblong transverse cross sectional shape of the shaft portion in a direction along a line of extension of said pre-heating chamber is greater than a dimension in a direction perpendicular to said line of extension, whereby when said plurality of piles of metal ingots approach said second end of the pre-heating chamber, the piles turn substantially sideways before falling down into said lower second end of the melting chamber, wherein the piles are melted by said burner means; and a reservoir chamber communicating with said lower second end of said melting chamber and extending therefrom substantially horizontally, said reservoir chamber storing a mass of molten metal obtained by melting said metal ingots in said melting chamber with said burner means.

6. An apparatus as set forth in claim 5, wherein said generally oblong transverse cross sectional shape of said shaft portion of the melting chamber is defined by a pair of opposed symmetrical arcs, and a pair of opposed parallel straight lines which extend in the direction along said line of extension of the pre-heating chamber.

7. An apparatus as set forth in claim 5, wherein said bottom wall of the pre-heating chamber is inclined downwardly toward said upper first end of the melting chamber.

8. An apparatus as set forth in claim 5, wherein said pre-heating chamber has a substantially rectangular transverse cross sectional shape.

9. An apparatus as set forth in claim 5, wherein said dimension of the generally oblong transverse cross sectional shape of said shaft portion along said line of extension of the pre-heating chamber is greater than a length of a diagonal line which connects a front upper corner and a rear lower corner in vertical cross section of each pile of metal ingots.

10. An apparatus as set forth in claim 5, wherein said pre-heating chamber includes an exhaust outlet in a portion of a side wall thereof adjacent to said first end thereof, exhaust gases produced in the melting chamber being discharged through said exhaust outlet.

11. An apparatus as set forth in claim 5, further comprising damper means having at least one damper member which is movable between a retracted position in an inner wall surface of the pre-heating chamber, and an operative position extending from said inner wall toward an opposite inner wall surface, wherein when the damper member is in its operative position, it directs the flow of exhaust gases from said melting chamber toward said pile of metal ingots.

12. An apparatus as set forth in claim 11, wherein said damper means includes a ceiling damper unit having a damper member which protrudes from a ceiling wall of the pre-heating chamber toward said pile of metal ingots in the pre-heating chamber when said damper member is moved from said retracted position to said operative position.

13. An apparatus as set forth in claim 11, wherein said damper means includes at least one side damper unit disposed on at least one of opposite side walls of the pre-heating chamber, each of said at least one side damper unit having a damper member which protrudes from a corresponding side wall toward said pile of metal ingots when said damper member is moved from said retracted position to said operative position.

14. An apparatus as set forth in claim 13, wherein said damper means further includes a ceiling damper unit which has a damper member which protrudes from a ceiling wall of the pre-heating chamber toward said pile of metal ingots in the pre-heating chamber when said damper member is moved from said retracted position to said operative position, the damper member of said ceiling damper unit being spaced from the damper member of said at least one side damper unit in the direction along said line of extension of the pre-heating chamber.

15. An apparatus as set forth in claim 11, wherein said damper comprises a plurality of damper units which are disposed on a ceiling wall and opposite side walls of the pre-heating chamber, said plurality of damper units being spaced apart from each other in the direction along said line of extension of the pre-heating chamber.

16. An apparatus as set forth in claim 11, wherein said pre-heating chamber is substantially rectangular in transverse cross section.

17. An apparatus as set forth in claim 11, wherein said damper means comprises a damper casing which is secured to a wall of said pre-heating chamber and open in the pre-heating chamber, said damper casing accommodating said damper member when the damper member is placed in the retracted position.

18. An apparatus for melting a mass of metallic material substantially in the form of a rectangular parallelepiped, comprising:

a pre-heating chamber having a first end and a second end and extending substantially horizontally, and through which said mass of metallic material is moved from said first end toward said second end;

a melting chamber for melting said mass of metallic material directly by a burner means, said burner means producing high-temperature exhaust gases which flow from said melting chamber into said pre-heating chamber to pre-heat said mass of metallic material to a predetermined temperature prior to melting thereof by said burner means; and damper means having at least one damper member which is movable between a retracted position in an inner wall surface of the pre-heating chamber, and an operative position extending from said inner wall surface toward an opposite inner wall surface, wherein when the damper member is in its operative position, it directs the flow of exhaust gases in the pre-heating chamber toward said mass of metallic material.

19. An apparatus as set forth in claim 11, wherein said damping means further comprises a heat resistant cushioning portion located at an end thereof closest to said opposite inner wall surface.

20. An apparatus as set forth in claim 18, wherein said damping means further comprises a heat resistant cushioning portion located at an end thereof closest to said opposite inner wall surface.

* * * * *